US011855374B2

(12) United States Patent
Moll

(10) Patent No.: US 11,855,374 B2
(45) Date of Patent: Dec. 26, 2023

(54) HOUSING AND CONNECTOR FOR A FLAT FLEXIBLE CABLE

(71) Applicant: TE Connectivity Services GmbH, Schaffhausen (CH)

(72) Inventor: Hurley Chester Moll, Middletown, PA (US)

(73) Assignee: TE Connectivity Solutions GmbH

( * ) Notice: Subject to any disclaimer, the term of this patent is extended or adjusted under 35 U.S.C. 154(b) by 49 days.

(21) Appl. No.: 17/581,267

(22) Filed: Jan. 21, 2022

(65) Prior Publication Data

US 2022/0393379 A1 Dec. 8, 2022

Related U.S. Application Data

(60) Provisional application No. 63/196,879, filed on Jun. 4, 2021.

(51) Int. Cl.
*H01R 12/77* (2011.01)
*H01R 43/20* (2006.01)

(52) U.S. Cl.
CPC ..... *H01R 12/778* (2013.01); *H01R 43/20* (2013.01)

(58) Field of Classification Search
None
See application file for complete search history.

(56) References Cited

U.S. PATENT DOCUMENTS 6,464,532 B1 * 10/2002 L'Abbate ..... H01R 12/772 439/499
6,746,269 B1 * 6/2004 Casses ..... H01R 4/2495 439/422
11,171,437 B2 * 11/2021 Arai ..... H01R 13/424

* cited by examiner

*Primary Examiner* — Ross N Gushi

(57) ABSTRACT

A connector includes a housing and a flat flexible cable disposed in the housing. The housing has a base and a cover movable with respect to the base between an open position and a closed position. The cover has a body and a protrusion protruding from the body. The flat flexible cable has an insulation material and a plurality of flat flexible conductors embedded in the insulation material. The flat flexible cable has an opening extending through the insulation material. The protrusion extends through the opening and abuts the base in the closed position of the cover.

19 Claims, 7 Drawing Sheets

HOUSING AND CONNECTOR FOR A FLAT FLEXIBLE CABLE

CROSS-REFERENCE TO RELATED APPLICATION

This application claims priority under 35 U.S.C. § 119 to United States Provisional Patent Application No. 63/196,879, filed on Jun. 4, 2021.

FIELD OF THE INVENTION

The present invention relates to a connector and, more particularly, to a connector and a housing for connection to a flat flexible cable.

BACKGROUND

Flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to round wire-based architectures. As a result, FFCs are being considered for many complex and/or high-volume applications, including wiring harnesses, such as those used in automotive manufacturing.

In many applications, FFCs are subject to forces that can pull or otherwise move the FFC with respect to a housing of a connector in which the FFC is connected. FFCs, however, are commonly only retained in the housing by the mechanical connection of the FFC to terminals retained in the housing. Forces acting on the FFC during use of the connector can strain the FFC and, without further securing of the FFC in the housing, can impair the electrical and mechanical connection between the FFC and the terminals, decreasing the reliability of the connector.

SUMMARY

A connector includes a housing and a flat flexible cable disposed in the housing. The housing has a base and a cover movable with respect to the base between an open position and a closed position. The cover has a body and a protrusion protruding from the body. The flat flexible cable has an insulation material and a plurality of flat flexible conductors embedded in the insulation material. The flat flexible cable has an opening extending through the insulation material. The protrusion extends through the opening and abuts the base in the closed position of the cover.

BRIEF DESCRIPTION OF THE DRAWINGS

The invention will now be described by way of example with reference to the accompanying Figures, of which.

DETAILED DESCRIPTION OF THE EMBODIMENTS

Figure 1:
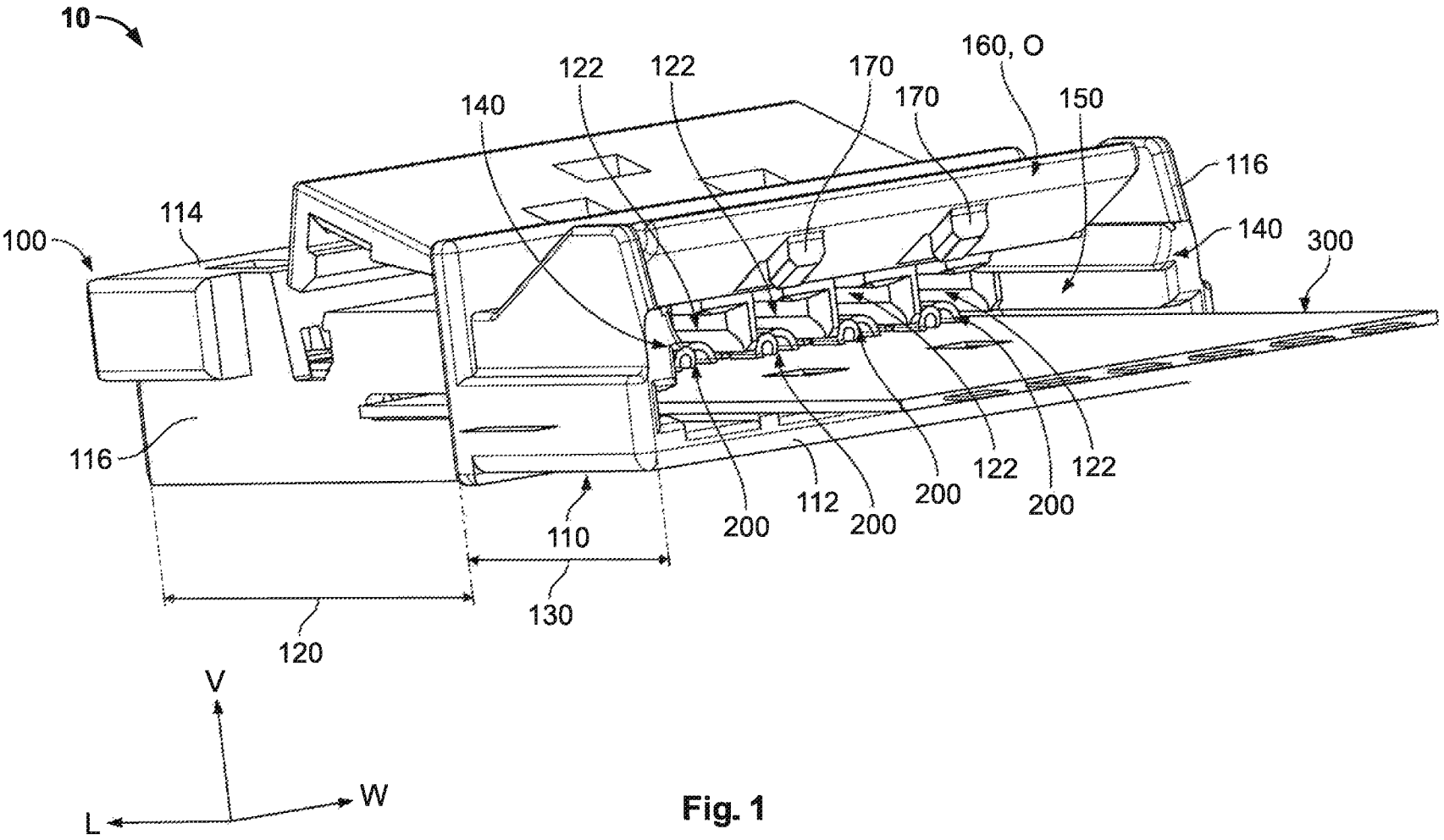
FIG. 1 is a perspective view of a connector according to an embodiment with a cover of a housing in an open position.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

A connector 10 according to an embodiment is shown in FIG. 1. The connector 10 comprises a housing 100, a plurality of terminals 200 disposed in the housing 100, and a flat flexible cable (FFC) 300 disposed in the housing 100 and electrically connected to the terminals 200.

Figure 2:
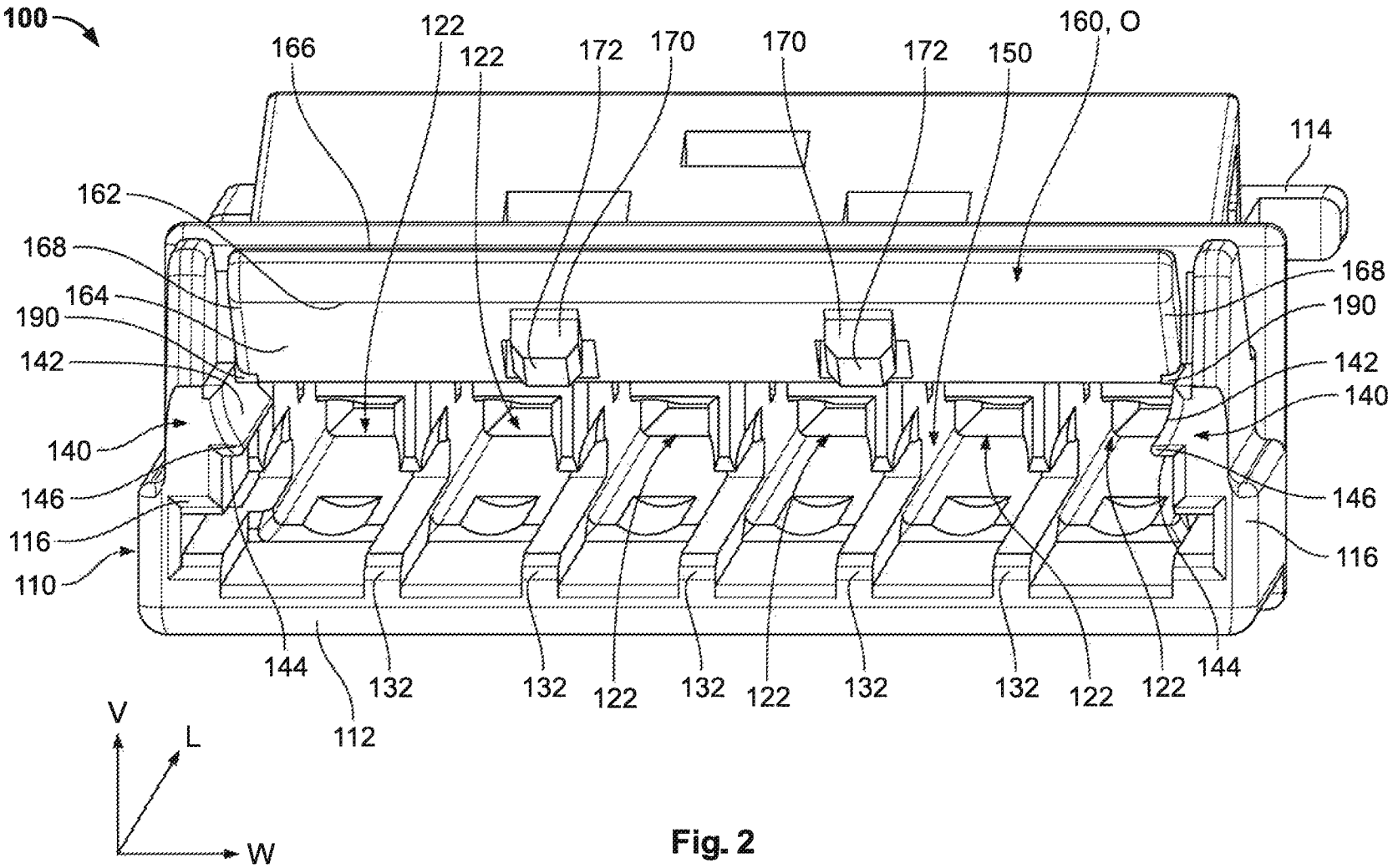
FIG. 2 is a perspective view of the housing of the connector with the cover in the open position.
Figure 3:
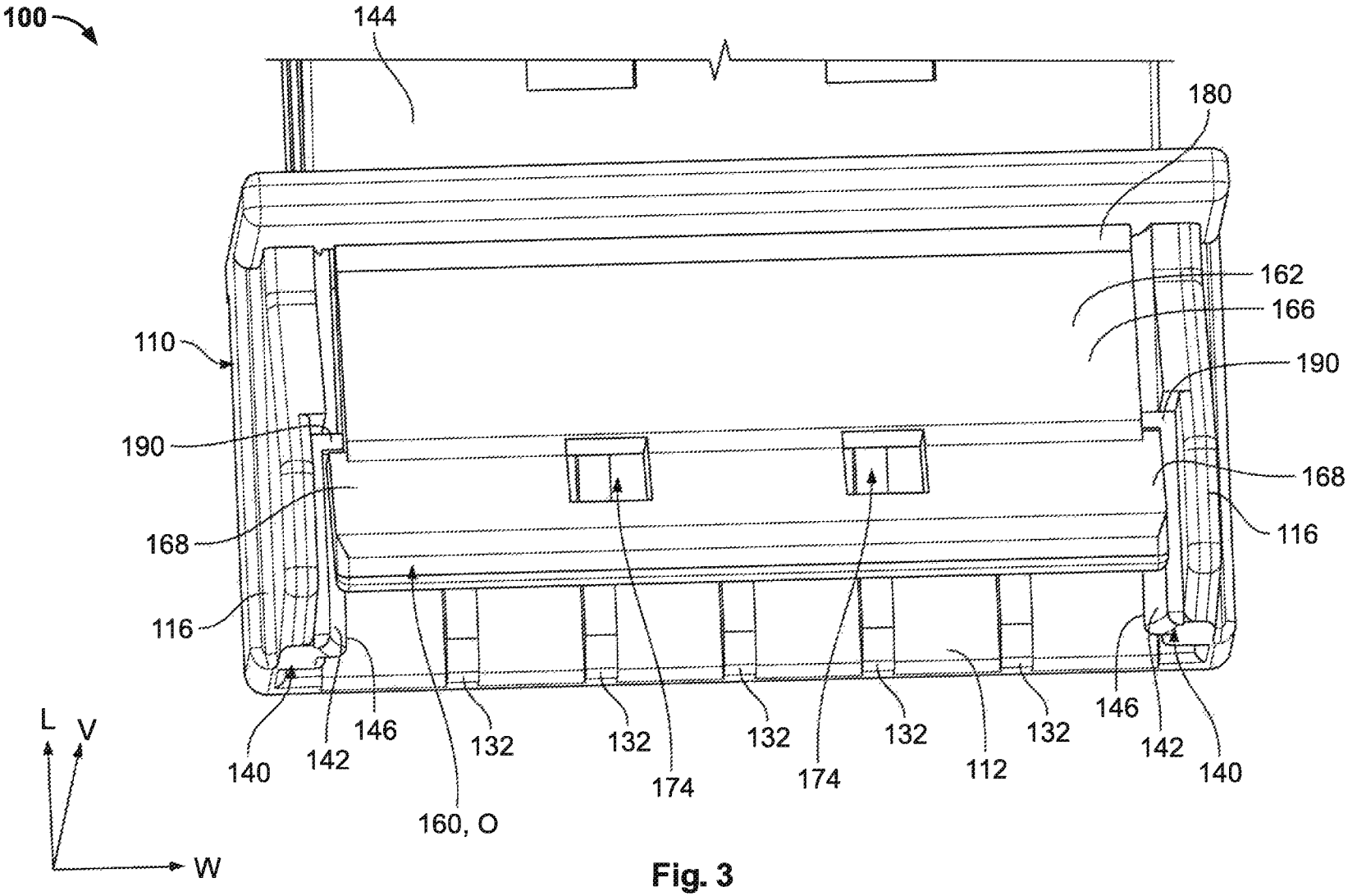
FIG. 3 is another perspective view of the housing of the connector with the cover in the open position.
Figure 5:
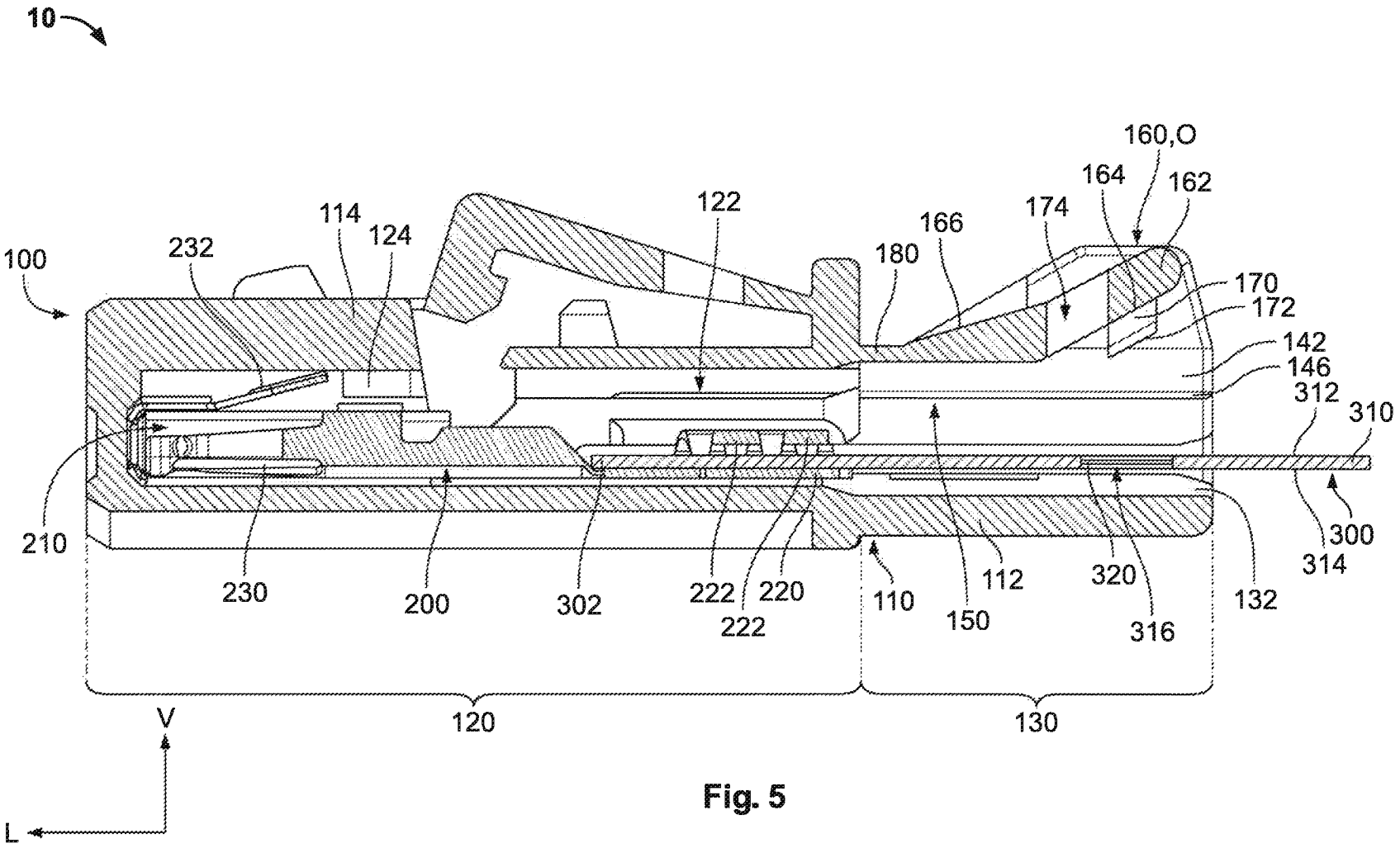
FIG. 5 is a sectional side view of the connector with the cover of the housing in the open position.
Figure 6:
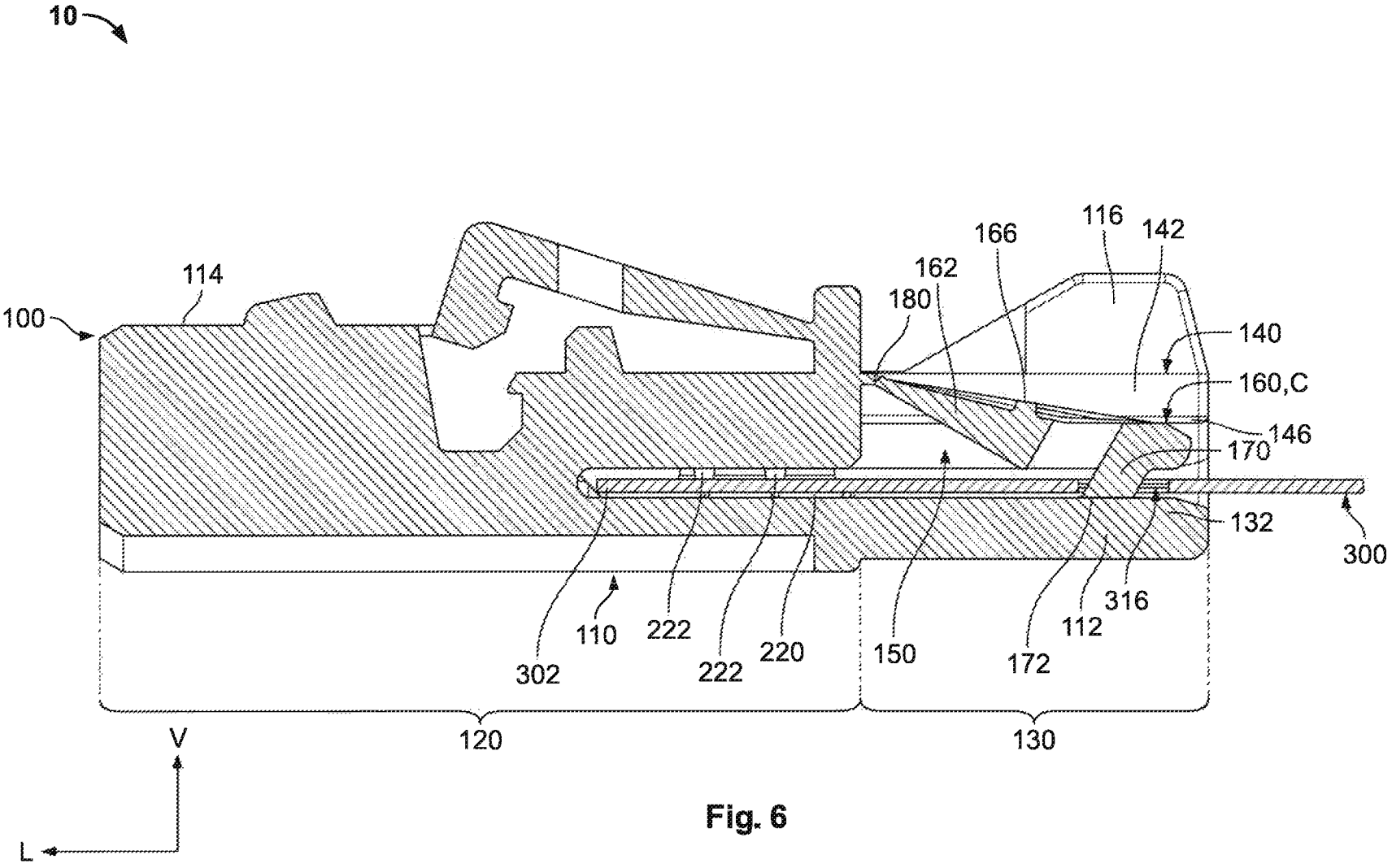
FIG. 6 is a sectional side view of the connector with the cover of the housing in a closed position.
Figure 7:
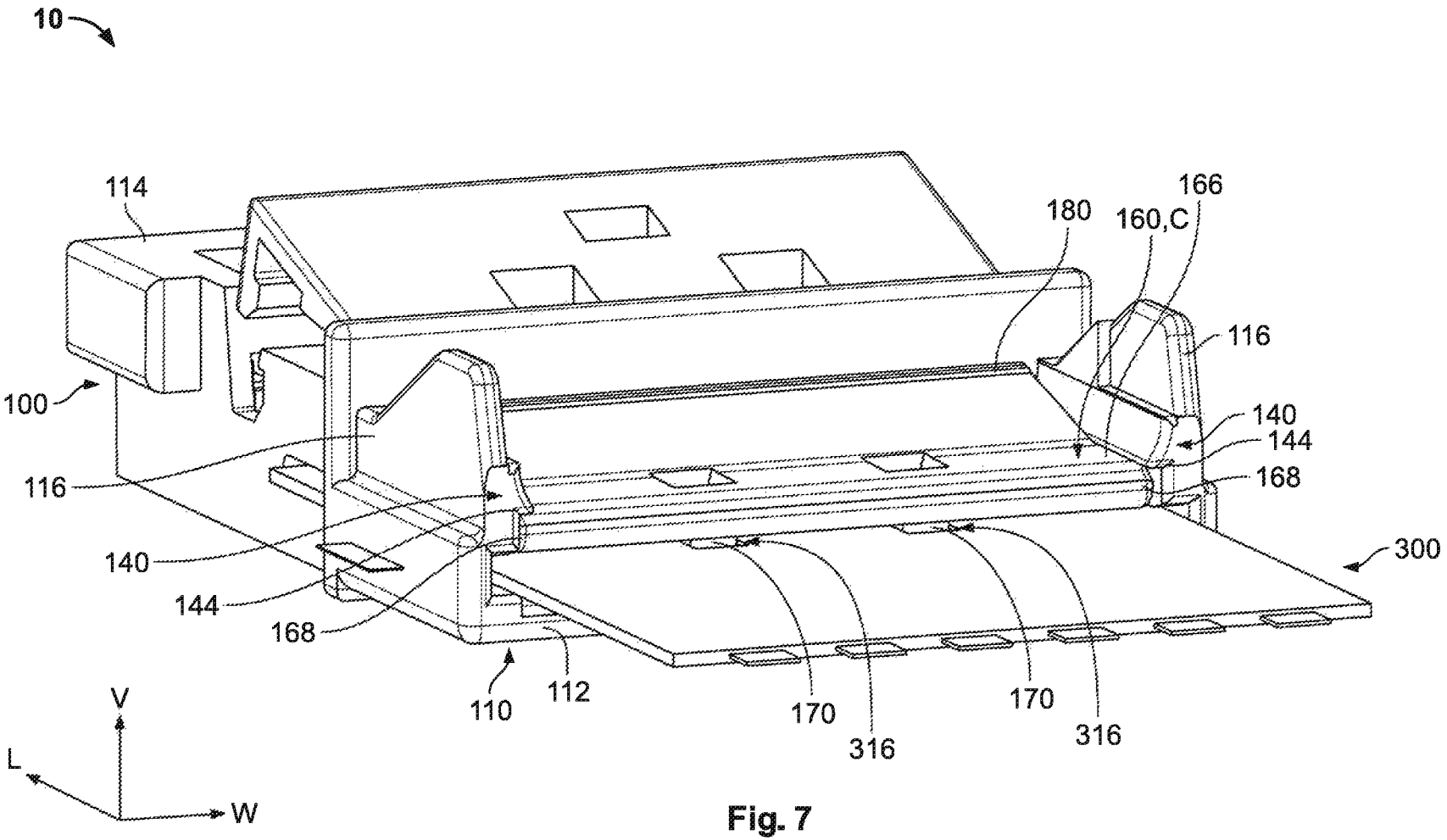
FIG. 7 is a perspective view of the connector with the cover of the housing in the closed position.

The housing 100, as shown in FIGS. 1-3, has a base 110 and a cover 160 movable with respect to the base 110 between an open position O, shown in FIGS. 1-3 and 5, and a closed position C, shown in FIGS. 6 and 7. In the shown embodiment, the base 110 is attached to the cover 160 by a hinge 180, shown in FIGS. 3 and 5-7, and the cover 160 is rotatable about the hinge 180 between the open position O and the closed position C.

As shown in FIGS. 1-3, the base 110 has a bottom wall 112 extending along longitudinal direction L, a top wall 114 opposite the bottom wall 112 in a vertical direction V perpendicular to the longitudinal direction L, and a pair of sidewalls 116 opposite one another in a width direction W perpendicular to the longitudinal direction L and the vertical direction V. The sidewalls 116 extend in the vertical direction V and connect the bottom wall 112 to the top wall 114.

The base 110, as shown in FIGS. 1 and 5, has a closed section 120 and an open section 130 extending from the closed section 120 along a longitudinal direction L. The closed section 120 encloses a plurality of receiving passageways 122 extending through the closed section 120 along the longitudinal direction L. As shown in FIG. 5, in each of the receiving passageways 122, the closed section 120 has a stop 124 extending from the top wall 114 and into the receiving passageway 122 along the vertical direction V.

In the open section 130, as shown in FIGS. 1 and 2, an interior receiving space 150 is defined between the bottom wall 112, the sidewalls 116, and the cover 160 in the open position O. As shown in FIGS. 2, 3, 5, and 6, a plurality of ribs 132 protrude from the bottom wall 112 into the interior receiving space 150 in the open section 130. In another embodiment, the ribs 132 may be omitted and a portion of the bottom wall 112 defining the interior receiving space 150 is planar.

As shown in FIGS. 1 and 2, each of the sidewalls 116 has a latch 140 protruding into the interior receiving space 150 in the open section 130. Each of the latches 140 has a sloped surface 142 positioned distal from the bottom wall 112 along the vertical direction V and a catch surface 144 extending from the sloped surface 142 and positioned proximal to the bottom wall 112 along the vertical direction V. The sloped surface 142 and the catch surface 144 intersect at a peak 146. The sloped surface 142 extends at an angle with respect to the vertical direction V and the width direction W and extends progressively further from the sidewall 116 nearer to the bottom wall 112 along the vertical direction V, reaching a maximum distance from the sidewall 116 at the peak 146. In the shown embodiment, the sloped surface 142 is a concave curve extending away from the sidewall 116 to the peak 146. In other embodiments, the sloped surface 142 may have a different curve or may extend linearly to the peak 146. The catch surface 144 extends parallel to the bottom wall 112 between the sidewall 116 and the peak 146.

The cover 160, as shown in FIGS. 2 and 3, has a body 162 with an inner surface 164 and an outer surface 166 opposite the inner surface 164. The inner surface 164 faces the interior receiving space 150 in the open position O of the cover 160. The cover 160 has a pair of flange elements 168 protruding from a portion of the body 162 in the width direction W. The flange elements 168 widen the cover 160 in the width direction W.

As shown in FIGS. 1 and 2, the cover 160 has a plurality of protrusions 170 protruding from the inner surface 164 of the body 162. The protrusions 170 extend into the interior receiving space 150 in the open position O of the cover 160. In the embodiment shown in FIGS. 1, 2, and 5, the protrusions 170 extend at an angle with respect to the inner surface 164 and parallel to the vertical direction V. Each of the protrusions 170 has an abutment surface 172 at an end opposite the body 162. In the shown embodiment, the abutment surface 172 is planar and parallel to the inner surface 164. In other embodiments, the abutment surface 172 can be angled or curved, the protrusion 170 can extend at other angles with respect to the inner surface 164, and the abutment surface 172 can extend at other angles with respect to the inner surface 164, provided that the abutment surface 172 can abut the bottom wall 112 in the closed position C of the cover 160 as described in detail below.

The cover 160, as shown in FIGS. 3 and 5, has a plurality of passageways 174 extending through the body 162 from the inner surface 164 to the outer surface 166. Each of the passageways 174 is positioned adjacent to one of the protrusions 170 along the longitudinal direction L. In an embodiment, the passageways 174 aid in the formation of the protrusions 170 by molding, described below.

In the embodiment shown in FIGS. 1 and 2, the cover 160 has two protrusions 170. The shown embodiment is merely exemplary and, in other embodiments, the cover 160 may have one protrusion 170 or three or more protrusions 170 formed as described above. The number of passageways 174 corresponds to the number of protrusions 170.

In the shown embodiment, the base 110 and the cover 160 are monolithically formed in a single piece, for example by injection molding, and the hinge 180 connecting the base 110 and the cover 160 is a film hinge. In other embodiments, the base 110 and the cover 160 can each be formed in separate pieces, for example each injection molded in a single piece separate from one another, and can be attached at the hinge 180 and rotatable about the hinge 180. The housing 100 is formed of an insulative material, such as a plastic.

In an embodiment in which the base 110 and the cover 160 are monolithically formed in a single piece by molding, the cover 160 is molded in the open position O shown in FIGS. 1-3 and 5. In this embodiment, a pair of connecting pieces 190 shown in FIGS. 2 and 3 can be formed in the molding process to extend between and connect the sidewalls 116 and the cover 160. The connecting pieces 190 retain the cover 160 in the open position O. In other embodiments, the connecting pieces 190 can be formed separately and attached between the cover 160 and the base 110, or can be omitted from the housing 100.

The plurality of terminals 200 are shown in detail in FIGS. 4 and 5; in FIG. 4, only one of the terminals 200 is labeled with reference numbers in detail for clarity of the drawings, but the elements described below and labeled on the one terminal 200 apply to each of the shown terminals 200. The terminals 200 each extend between a mating end 210 and an attachment end 220 along the longitudinal direction L. At the attachment end 220, the terminals 200 each have a plurality of crimping wings 222 in the shown embodiment. The terminals 200 are formed of a conductive material, such as copper or aluminum. Six terminals 200 are provided in the shown embodiment, however, the embodiment is merely exemplary and the number of terminals 200 could be less than six, including one, or could be more than seven depending on the application.

Figure 4:
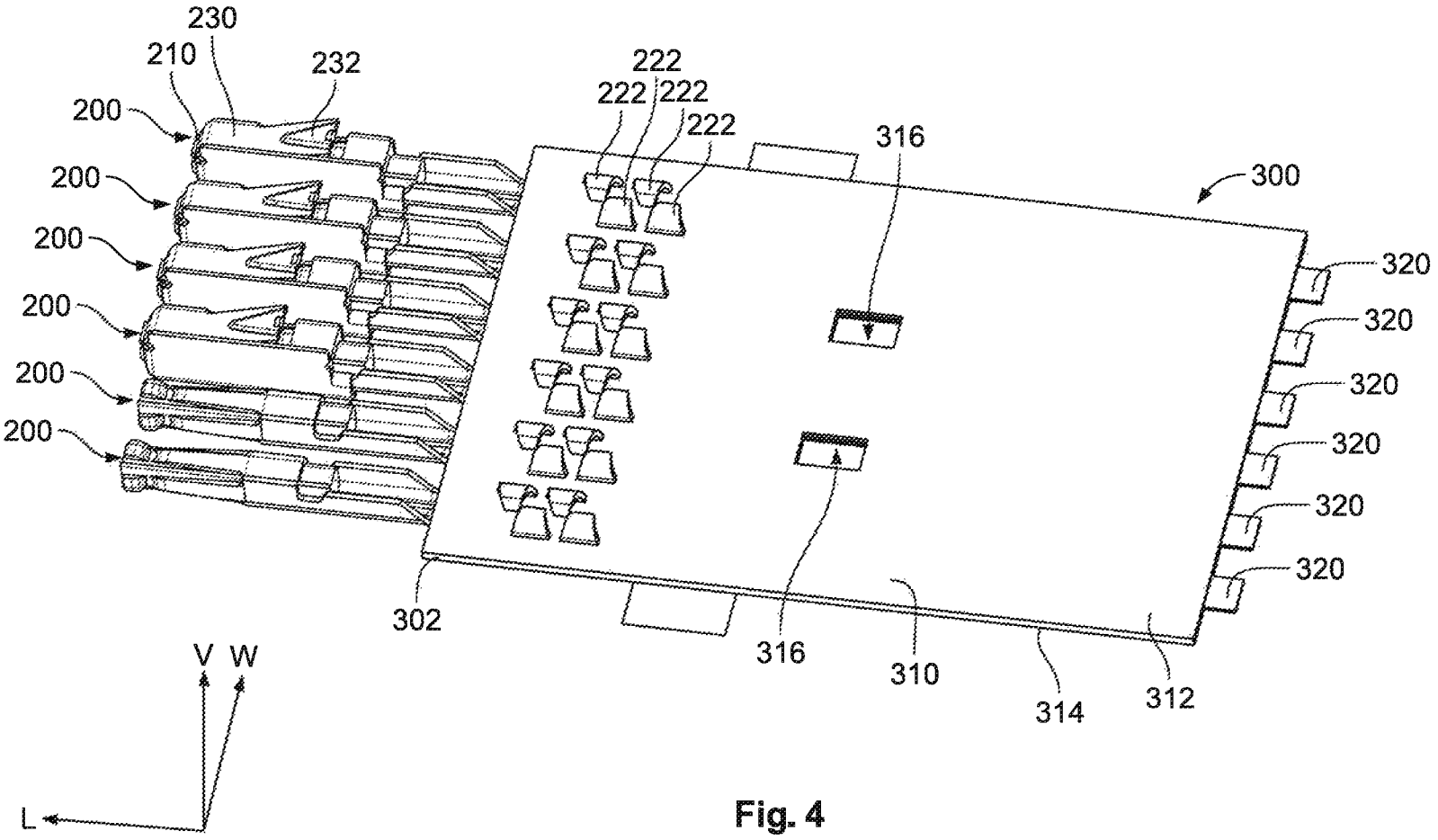
FIG. 4 is a perspective view of a plurality of terminals connected to a flat flexible cable.

In the embodiment shown in FIGS. 4 and 5, the terminals 200 each have a sleeve 230 disposed around the terminal 200 at the mating end 210. The sleeve 230 has a latching arm 232 extending away from the sleeve 230. The latching arm 232 is resiliently deflectable. In another embodiment, the sleeve 230 is omitted and the latching arm 232 is monolithically formed in a single piece with the mating end 210 and the attachment end 220. FIG. 4 shows the sleeve 230 of some of the terminals 200 removed only for ease of understanding of the described parts; in the shown embodiment, each of the terminals 200 has the sleeve 230.

The FFC 300, as shown in FIG. 4, has an insulation material 310 and a plurality of flat conductors 320 embedded in the insulation material 310. In an embodiment, the flat conductors 320 are each a metallic foil, such as a copper foil, by way of example only, patterned in any desirable configuration. The insulation material 310, such as a polymer insulation material, may be applied to either or both sides of the flat conductors 320 via an adhesive material or extruded directly over the flat conductors 320. The flat conductors 320 may also be referred to as conductors 320 herein. The insulation material 310 has an upper side 312 and a lower side 314 opposite the upper side 312 in the vertical direction V, as shown in FIG. 4. The conductors 320 are embedded in the insulation material 310 between the upper side 312 and the lower side 314.

As shown in the embodiment of FIG. 4, the FFC 300 has a plurality of openings 316 extending through the insulation material 310. The openings 316 are positioned between the conductors 320. In the shown embodiment, the FFC 300 has two openings 316. In other embodiments, the FFC 300 could have any number of openings 316, including only one opening 316, provided that the number of openings 316 corresponds to the number of protrusions 170 of the cover 160. The openings 316 are positioned in the insulation material 310 to correspond to the position of the protrusions 170, as described below.

The assembly of the connector 10 will now be described in greater detail primarily with reference to FIGS. 4-7.

The terminals 200 are electrically and mechanically connected to the FFC 300, as shown in FIG. 4. An end 302 of the FFC 300 is positioned over the attachment end 220 of each of the terminals 200 and, with the crimping wings 222 in an open position, the crimping wings 222 pierce through the insulation material 310 from the lower side 314 to the upper side 312. The crimping wings 222 corresponding to each terminal 200 border one conductor 320 of the FFC 300; the number of conductors 320 in the insulation material 310 corresponds to the number of terminals 200 used in the connector 10. When the crimping wings 222 have pierced through the upper side 312 of the insulation material 310, the crimping wings 222 are bent by crimping back through the upper side 312 and into contact with the corresponding conductor 320, mechanically and electrically securing the terminal 200 to the FFC 300. In other embodiments, portions of the FFC 300 can be stripped, and the attachment ends 220 of the terminals 200 can have elements other than the crimping wings 222 that, individually or in combination, are capable of forming a mechanical and an electrical connection with the FFC 300, such as resilient contact springs and/or serrated contact surfaces.

With the cover 160 in the open position O, the terminals 200 attached to the FFC 300 are inserted into the housing 100, as shown in FIGS. 1 and 5. Each of the terminals 200 is inserted into one of the receiving passageways 122 along the longitudinal direction L. Each of the latching arms 232 contacts the stop 124 in the corresponding receiving passageway 122 and deflects during insertion. When the terminal 200 reaches the position shown in FIG. 5, the latching arm 232 elastically restores and is prevented from movement along the longitudinal direction L by the stop 124, securing the terminal 200 in an inserted position in the receiving passageway 122.

In the position shown in FIGS. 1 and 5, a portion of the FFC 300 having the openings 316 is disposed in the open section 130 of the base 100. In the shown embodiment, the lower side 314 of the FFC 300 rests on the ribs 132. In embodiments without the ribs 132, the lower side 314 of the FFC 300 can rest directly on the bottom wall 112.

With the terminals 200 connected to the FFC 300 fully inserted into the housing 100, the cover 100 is rotated from the open position O, shown in FIGS. 1 and 5, to the closed position C, shown in FIGS. 6 and 7. In an embodiment in which the connecting pieces 190 extend between the cover 160 and the sidewalls 116, the connecting pieces 190 are frangible. The connecting pieces 190 are sufficiently strong to hold the cover 160 in the open position O prior to intentional movement of the cover 160, but break when the cover 160 begins to be rotated about the hinge 180, under either manual or machine movement, from the open position O toward the closed position C in order to complete assembly and securing of the connector 10.

In the open position O of the cover 160, as shown particularly in FIGS. 2 and 3, the flange elements 168 are positioned over the latches 140 in the vertical direction V and overlap the latches 140 in the vertical direction V. As the cover 160 is rotated about the hinge 180 from the open position O to the closed position C, the flange elements 168 first contact the sloped surfaces 142 of the latches 140. As the cover 160 continues to be rotated toward the closed position C, the flange elements 168 move further along the sloped surfaces 142 toward the peak 146, resulting in an outward force on the latches 140 and elastic deformation of the flange elements 168, elastic deformation of the sidewalls 116 with the latches 140, or elastic deformation of both the flange elements 168 and the sidewalls 116 with the latches 140.

When the flange elements 168 move past the peaks 146 during rotation of the cover 160, deformation of the flange elements 168 and/or the sidewalls 116 with the latches 140 is elastically restored and the latches 140 snap-fit with the flange elements 168 in the closed position C of the cover 160, as shown in FIGS. 6 and 7. The outer surface 166 of the cover 160 abuts the catch surface 144 of the latches 140 to secure the cover 160 in the closed position C.

As shown in FIG. 6, as the cover 160 is rotated toward the closed position C, the protrusions 170 each move into one of the openings 316 in the insulation material 310 of the FFC 300 that is disposed in the open section 130. When the cover 160 reaches and is held in the closed position C, the abutment surfaces 172 each abut against one of the ribs 132. The abutment surfaces 172 are pressed against the ribs 132 by a force provided by the latches 140 engaging or snap-fitting with the flange elements 168. In another embodiment without the ribs 132, the abutment surfaces 172 abut and are pressed against an inner surface of the bottom wall 112.

The securing of the cover 160 in the closed position C and the holding of the protrusions 170 in the openings 316 provides strain relief for the FFC 300. If the FFC 300 is pulled or otherwise moved with respect to the housing 100 during use of the connector 10, the protrusions 170 engage the insulation material 310 of the FFC 300 around the openings 316 to provide support restricting the movement, prior to the movement impacting either the connection of the FFC 300 to the terminals 200 or the securing of the FFC 300 and terminals 200 in the housing 100. The connector 10 as described herein can allow for a more reliable connection between the FFC 300 and the terminals 200 and better retention of the FFC 300 in the housing 100 in a variety of application conditions.

What is claimed is:

1. A connector, comprising:

a housing having a base and a cover movable with respect to the base between an open position and a closed position, the cover has a body and a plurality of protrusions protruding from the body, the cover has a plurality of passageways discrete from one another extending through the body and each positioned adjacent to one of the protrusions along a longitudinal direction; and a flat flexible cable extending along the longitudinal direction and disposed in the housing, the flat flexible cable has an insulation material and a plurality of flat flexible conductors embedded in the insulation material, the flat flexible cable has a plurality of openings extending through the insulation material, each of the protrusions extends through one of the openings and abuts the base in the closed position of the cover.

2. The connector of claim 1, wherein the base has a latch and the cover has a flange element, the flange element engages the latch in the closed position.

3. The connector of claim 2, wherein the base has a bottom wall and a pair of sidewalls extending from the bottom wall along a vertical direction, the latch is disposed on each of the sidewalls.

4. The connector of claim 3, wherein the latch has a sloped surface distal from the bottom wall along the vertical direction and a catch surface proximal to the bottom wall along the vertical direction and extending from the sloped surface, the catch surface extends parallel to the bottom wall.

5. The connector of claim 4, wherein the flange element protrudes from the body of the cover and widens the cover in a width direction perpendicular to the vertical direction.

6. The connector of claim 5, wherein the flange element abuts the catch surface in the closed position.

7. The connector of claim 1, wherein the base has a closed section and an open section extending from the closed section along a longitudinal direction, an interior receiving space in which the flat flexible cable is disposed is defined between the cover and the base in the open section.

8. The connector of claim 7, wherein the base has a bottom wall and a rib protruding from the bottom wall in the open section, a lower side of the flat flexible cable is disposed on the rib and one of the protrusions abuts the rib in the closed position.

9. The connector of claim 7, wherein the base has a plurality of receiving passageways extending through the closed section along the longitudinal direction, and further comprising a plurality of terminals disposed in the housing, each of the terminals is disposed in one of the receiving passageways.

10. The connector of claim 9, wherein each of the terminals has a latching arm engaging a stop in one of the receiving passageways.

11. The connector of claim 9, wherein each of the terminals has a plurality of crimping wings crimped to the flat flexible cable, the crimping wings of each of the terminals mechanically and electrically contact one of the flat flexible conductors.

12. The connector of claim 1, wherein the base, the cover, and the protrusions are monolithically formed in a single piece.

13. The connector of claim 1, wherein the protrusions each have has an abutment surface at an end opposite the body, the abutment surface abuts a bottom wall of the base in the closed position of the cover and extends at an angle with respect to the bottom wall in the open position.

14. The connector of claim 1, wherein the openings extending through the insulation material are disposed between the flat flexible conductors.

15. A method of connecting a flat flexible cable, comprising:

providing a housing having a base and a cover movable with respect to the base between an open position and a closed position, the cover has a body and a plurality of protrusions protruding from the body, the cover has a plurality of passageways discrete from one another extending through the body and each positioned adjacent to one of the protrusions along a longitudinal direction;

inserting the flat flexible cable into the housing, the flat flexible cable extends along the longitudinal direction and has an insulation material and a plurality of flat flexible conductors embedded in the insulation material, the flat flexible cable has a plurality of openings extending through the insulation material; and moving the cover with respect to the base from the open position to the closed position, each of the protrusions extends through one of the openings and abuts the base in the closed position of the cover.

16. The method of claim 15, wherein the base has a latch and the cover has a flange element, the flange element engages the latch in the closed position.

17. The method of claim 16, wherein the flange element moves along a sloped surface of the latch as the cover moved from the open position to the closed position, at least one of the cover and the base elastically deforms as the flange element moves along the sloped surface.

18. The method of claim 15, further comprising inserting a plurality of terminals into the housing prior to inserting the flat flexible cables into the housing, the terminals are retained in the housing and electrically and mechanically connect to the flat flexible conductors of the flat flexible cable.

19. The method of claim 15, wherein the housing is molded in a single piece with the cover in the open position, a connecting piece connecting the cover to the base is broken when the cover is rotated out of the open position.

* * * * *